US008884685B1

(12) United States Patent
Petrovic

(10) Patent No.: US 8,884,685 B1
(45) Date of Patent: Nov. 11, 2014

(54) ADAPTIVE DYNAMIC VOLTAGE SCALING SYSTEM AND METHOD

(71) Applicant: Entropic Communications, Inc., San Diego, CA (US)

(72) Inventor: Branislav Petrovic, La Jolla, CA (US)

(73) Assignee: Entropic Communications, Inc., San Diego, CA (US)

( * ) Notice: Subject to any disclaimer, the term of this patent is extended or adjusted under 35 U.S.C. 154(b) by 0 days.

(21) Appl. No.: 13/970,575

(22) Filed: Aug. 19, 2013

(51) Int. Cl.
*G05F 1/10* (2006.01)
*G05F 1/46* (2006.01)

(52) U.S. Cl.
CPC ..... *G05F 1/46* (2013.01)
USPC ..... 327/540

(58) Field of Classification Search
USPC ..... 327/534, 535, 538, 540, 541
See application file for complete search history.

(56) References Cited

U.S. PATENT DOCUMENTS 6,838,927 B2 * 1/2005 Oonishi ..... 327/534
8,378,739 B2 * 2/2013 Notani et al. ..... 327/540
8,395,440 B2 * 3/2013 Sandhu et al. ..... 327/540

* cited by examiner

*Primary Examiner* — Jeffrey Zweizig
(74) *Attorney, Agent, or Firm* — Richard Bachand; Bruce Greenhaus; The Law Offices of John Land

(57) ABSTRACT

Integrated circuit designs and methods using adaptive dynamic voltage scaling circuits for IC designs that compensate for some of the effects of PVT dependent characteristics on the fabrication of advanced IC's but allow lower margins and provide high die yields, smaller die size, and lower power usage. An inner control loop varies the voltage output of an internal variable voltage regulator powered by an IC circuit voltage, and monitors the operation of a test circuit until it reaches a cross-over point (i.e., either fails to operate or begins to operate) with respect to an essentially identical nearby reference circuit, at which point the IC circuit voltage is adjusted by an outer control circuit to that voltage output level plus a margin.

12 Claims, 2 Drawing Sheets

ADAPTIVE DYNAMIC VOLTAGE SCALING SYSTEM AND METHOD

BACKGROUND (1) Technical Field

This disclosure relates to electronic circuits, and more particularly to integrated circuit designs and methods using adaptive dynamic voltage scaling.

(2) Background

The translation of integrated circuit designs from circuit diagrams or hardware programming code to working integrated circuits (IC's) implemented in modern transistor technologies remains as much art as engineering. A significant challenge in fabricating IC's is to control circuit parameters (such as delay, transistor threshold voltage, and transistor transconductance parameters) in view of variations in the semiconductor fabrication process, IC supply voltage, and IC operating temperature (often abbreviated as "PVT", for "Process", "Voltage", and "Temperature" parameters).

Process variations during IC manufacture can cause unpredictable and undesired variations of circuit parameters, which can adversely affect circuit performance. "Process variation" is the naturally occurring variation of the attributes of transistors (e.g., geometry, such as length and width, and film and oxide thickness, as well as doping concentrations, etc.) when integrated circuits are fabricated. In addition, the parameters of individual transistors vary from wafer-to-wafer (interprocess variation) and die-to-die (intraprocess variation). Process variation becomes particularly important as the dimensions of components of the IC became smaller (<65 nm) and the variation become a larger percentage of the full length or width of the devices. At some point, feature sizes approach fundamental dimensions, such as the size of atoms and the wavelength of usable light for patterning lithography masks.

The above circuit parameters generally exhibit complex relationships among each other. For example, threshold voltage and transconductance are important circuit parameters, yet very difficult to control in precision analog circuits. In particular, transistor threshold voltage is very critical in determining propagation speed for high speed, low voltage digital circuits.

In addition to the transistors themselves, there are other on-chip variation (OCV) effects that manifest themselves when devices within an IC get very small. These include PVT variation effects on on-chip interconnects as well as via structures. In addition, there are wafer-to-wafer and intra-wafer variations within the bulk material of wafers, both in initial form and post-doping.

In other words, circuit parameters tend to be process dependent. Thus, it is useful for a manufacturer to be able to compensate for process variations applicable to a particular IC design, taking into account a range of supply voltages and operating temperatures, in order to meet a design specification and maximize IC die yields for that design.

Another problem in the translation of IC design to IC die is that in modern advanced transistor technologies, the power supply voltage is much lower compared to older technologies. For example, in 180 nm fabrication technology the recommended power supply voltage is 1.8V, while for 130 nm fabrication technology the recommended voltage is 1.5V, and for 28 nm fabrication technology the recommended voltage is 1.0V (nominal). In order to enable fast transistors with low overdrive voltages and reduced power supply voltages, the threshold voltage of the transistors must be smaller to at least maintain or even increase the speed of the transistors. While decreasing the threshold voltage of the transistors in advanced technologies is mandatory to achieve the desired speed, it negatively impacts the current leakage performance of the technology: a smaller threshold voltage results in faster devices, but faster devices have higher current leakage.

A number of approaches have been taken to compensate for the problems engendered by PVT dependent characteristics of advanced IC's. For example, one approach to dealing with performance differences caused by unique die-to-die response to an applied power supply voltage (i.e., where the same power supply voltage is provided to nominally identical but differently performing IC dies) is to provide for dynamic voltage scaling on an IC. FIG. 1 is a block diagram of a typical dynamic voltage scaling circuit 100 in accordance with the prior art. Prior art dynamic voltage scaling (DVS) essentially includes the following:

Measurement of Local Voltage Dependent Die Characteristics:

Each IC is provided with means to measure the speed of the implementation technology as a function of applied voltage. Such means may be a voltage dependent test circuit 102, such as one or more ring oscillators based on standard cell digital gates (even for an analog IC). As is known in the art, the frequency (i.e., speed) of such ring oscillators is dependent on the process speed, applied voltage, operating temperature, and the implementation characteristics of the individual devices comprising each ring oscillator structure. The ring oscillators should be based on the standard cells sizes used in the design (e.g., 7-track, 10-track, 12-track, 14-track, etc.; a circuitry cell in a standard cell library is laid out relative to a grid defined by horizontal and vertical tracks, and a cell library is generally classified by its track height; for example, a 10-track library is composed of cells having heights of 10 tracks or an integer multiple thereof, and thus a 10-track library has smaller cell sizes than a 12-track library). Each ring oscillator also should be implemented using transistor types similar to the ones used on the IC in the region of the ring oscillator, such as ultra-high Vt (UHVT), high Vt (HVT), standard Vt (SVT), low Vt (LVT), and ultra-low Vt (ULVT) transistors.

Comparison of the Measured Value to a Target Value:

The output of the speed measuring means is compared to a target value determined in any of various known ways. For example, the output of a ring oscillator comprising the voltage dependent test circuit 102 may be compared against the output of a target frequency source 104 (which may be derived, for example, from a crystal oscillator and adjusted to a selected target value), using, for example, a comparator 106 comprising a delay-locked loop (DLL) to compare the target frequency and the measured frequency of each ring oscillator. The DLL output is a signal (generally a digital signal) that reflects the difference in frequency between the voltage dependent test circuit 102 and the target frequency source 104. Alternatively, a counter can be used to measure the periods of the ring oscillators to determine their speed.

Feedback Control of the Power Supply Voltage:

The output of the comparison of the target frequency and the measured frequencies from the comparator 106 is applied to a means for controlling an external power supply to the IC, such as a variable voltage regulator 108, which adjusts the applied power supply higher or lower depending on the result of the frequency comparison. For example, the output of the comparison may be a pulse width modulation (PWM) signal. The PWM duty cycle can be used in known fashion to increase or decrease the power supply voltage in order to match the speed of the ring oscillators to the target frequency. If the ring oscillators are operating too slow, the applied power supply voltage is increased; conversely, if the ring oscillators are operating too fast, the applied power supply voltage is decreased. A typical adjustment range for a power supply using this approach is about ±10% (e.g., for a normalized voltage value of 1.0, the range is from about 0.9 to 1.1). For example, for a 28 nm node process, the IC circuit supply voltage range (Vdd) may be limited to between 0.9 Vmin and 1.1 Vmax. In reality, many individual ICs could operate at voltages below the 0.9V limit (and thus dissipate less power), but because of the worst case units, the entire population must be subjected to this limit to secure sufficient margin with the prior art method.

An IC design normally would have multiple DVS cells 110 distributed judicially across the IC die such that the voltage dependent test circuits 102 (e.g., ring oscillators) rather thoroughly reflect the transistor speed variations that occur across the dimensions of the die. When using multiple DVS cells 110, some economies of scale will be readily apparent to those skilled in the art, such as having only one target frequency source 104 coupled to all DVS cells 110, and time sharing (multiplexing) a single comparator 106 with all DVS cells 110.

Despite such attempts to mitigate the effects of PVT dependent characteristics on the fabrication of advanced IC's, IC designers and manufacturers have still been conservative in their approach to setting margins for IC designs (i.e., acceptable ranges of circuit parameters that result in fully functional IC's that meet all design specifications despite PVT variations). While a conservative approach seemingly improves die yields, the result generally is larger dies and more power usage (and thus more heat), in order to achieve the required performance and speed. This is because of the relatively large safety margin necessary with the prior art method, where basically the worst case units dictate the treatment of the whole population, without an ability to adaptively optimize operating conditions for each individual case. For example, a designer may choose to use five sigma instead of four sigma (of the deviation values of the variance obtained in a characterization step) for setting the Vdd supply voltage margin to reduce the probability of failure from a few tens of parts per million (ppm) to a few ppm, making the design more reliable. But this conservative approach results in a higher operating Vdd, and thus higher power dissipation. Another example is when a designer chooses to use a ULVT device instead of an SVT device in critical circuits in order to obtain higher margin. However, doing so will result in a larger circuit size and higher leakage power.

Accordingly, there is a need for an IC design that compensates for the effects of PVT dependent characteristics on the fabrication of advanced IC's but results in lower margins, smaller die size, higher die yields, and lower power usage in comparison to the prior art. The disclosed method and apparatus addresses this need.

SUMMARY

An adaptive dynamic voltage scaling (DVS) circuit in accordance with the disclosed method and apparatus includes a number of adaptive DVS test cells. Each adaptive DVS test cell includes a test circuit which is designed to be process, temperature, and voltage dependent so that critical timing can be tested and failures detected when the voltage applied to the test circuit becomes too low. Each test circuit should be based on the standard cells sizes used in the IC design and also should be implemented using transistor types similar to the ones used on the IC in the region of the test circuit.

Each test circuit is coupled to an internal variable voltage regulator. Each internal variable voltage regulator is coupled to another variable voltage regulator. In one embodiment this other regulator is external to the adaptive DVS test cell circuitry; although it may still be on the same die as the test cell circuitry. Each internal variable voltage regulator provides an output voltage Vdd test from a voltage Vdd provided by the external variable voltage regulator.

Each adaptive DVS test cell also includes a reference circuit that is identical (or substantially similar) to the test circuit within that test cell. Each reference circuit is coupled to the output voltage Vdd of the external variable voltage regulator, and provides a "reference" or "template" for comparison against which the operation of an associated test circuit is judged.

In the preferred embodiment, the test circuit and reference circuit of each adaptive DVS test cell are physically placed at close proximity to each other on the die, thus minimizing spatial geometry/doping/temperature differences. Because the test circuit and reference circuit of each adaptive DVS test cell are essentially the same, and physically placed at close proximity to each other on the die, both should perform essentially identically at the same applied voltage.

The outputs of the test circuit and the reference circuit of each adaptive DVS test cell, along with the Vdd_test output of the associated internal variable voltage regulator, are coupled to a comparison and detection circuit. The comparison and detection circuit may also include a simple sequencer that outputs a control voltage to the internal variable voltage regulator that drives an adaptive DVS test cell, and causes the output Vdd_test of the internal variable voltage regulator to decline from (approximately) Vdd to a lower voltage until the comparison and detection circuit indicates that the outputs of the test circuit and the reference circuit are no longer identical (a decrementing approach). Alternatively, the internal variable voltage regulator can be operated with an initially low output value (e.g., 70% of Vdd) which is increased until the test circuit changes from a non-operational state to an operational state (an incrementing approach).

More simply, in the decrementing approach, the comparison and detection circuit behaves as an inner control loop that drives the Vdd_test output of an internal variable voltage regulator (which only powers the test circuit of a test cell) down from Vdd and monitors the operation of the test circuit until a cross-over point is achieved where the test circuit fails to operate like the reference circuit (which is always powered by Vdd). In the alternative incrementing approach, the inner control loop drives the Vdd_test output of the internal variable voltage regulator up towards Vdd from a starting value below the operating voltage required by the test circuit, until a cross-over point is achieved where the test circuit begins to operate like the reference circuit.

In either case, when the cross-over point is detected, the voltage level of Vdd_test at that point (=Vxover) is measured or determined by the comparison and detection circuit. The comparison and detection circuit may also include measurement of the Vdd voltage, or measurement of the difference between the Vdd and Vdd_test voltages. The Vdd value or the difference Vdd−Vdd_test value may be reported to an outer loop controller circuit.

Once a test circuit cross-over point occurs in an adaptive DVS test cell, in the preferred embodiment a margin is added to Vxover and the output Vdd of the external variable voltage regulator is adjusted so that Vdd=Vxover+margin. Such adjustment may be accomplished in known fashion by an outer loop controller that controls the external variable voltage regulator in response to the determination of Vxover by the comparison and detection circuit.

In general, the margin added to the Vxover should be as small as possible, but sufficient to ensure reliable operation. The value of the margin may be fixed or may be programmable, optimized based on factors such as voltage ripple, voltage measurement or comparison accuracy, and other uncertainties in the system.

For most designs, it is beneficial to have a plurality of adaptive DVS test cells distributed across an IC die such that the test circuits and reference circuits reflect the transistor speed variations that occur across the dimensions of the die due to process variations and characteristics of the die doping and geometry. When more than one adaptive DVS test cell is implemented in an IC design, the outer loop controller may include the ability to determine the highest value of Vxover ("Vxover_max") determined by the different adaptive DVS test cells (i.e., the worst case instance) and set the external variable voltage regulator such that Vdd=Vxover_max+margin.

An advantage of the disclosed method and apparatus in comparison with the prior art is that the disclosed method and apparatus allows each IC die to be non-intrusively tested while in actual operation to determine the actual minimum voltage at which the circuitry on that die will operate (and below which the circuitry fails), and then adds some margin to that measured minimum voltage level to ensure proper operation. Further, the disclosed method and apparatus allows the measurement of minimum operational voltage to be made on a real-time basis, thus allowing periodic adjustment of the applied Vdd voltage to track and meet current conditions (e.g., environmental conditions such as temperature, and aging effects on an IC die).

By measuring the actual minimum voltage at which the circuitry on an IC die will operate, the adaptive DVS approach of the disclosed method and apparatus can lower the applied Vdd voltage to that instance of the IC design below the level that would be set by the frequency-based testing of the prior art DVS approach, thereby achieving power savings in comparison to the prior art.

The details of one or more embodiments of the disclosed method and apparatus are set forth in the accompanying drawings and the description below. Other features, objects, and advantages of the disclosed method and apparatus will be apparent from the description and drawings, and from the claims.

DESCRIPTION OF THE DRAWINGS

Like reference numbers and designations in the various drawings indicate like elements.

DETAILED DESCRIPTION

The disclosed method and apparatus encompasses integrated circuit designs and methods using adaptive dynamic voltage scaling for IC designs that compensate for some of the effects of PVT dependent characteristics on the fabrication of advanced IC's but allow lower margins and provide high die yields, smaller die size, and lower power usage in comparison to the prior art.

Figure 1:
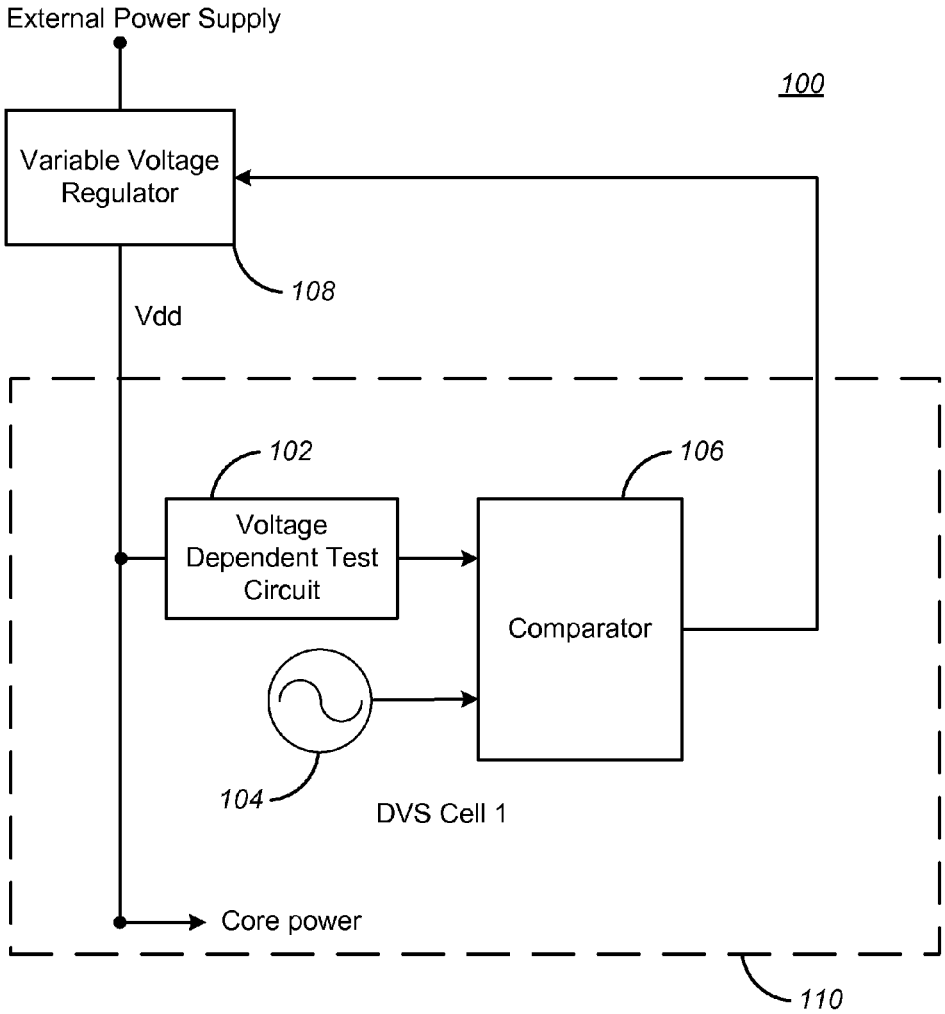
FIG. 1 (Prior Art)
FIG. 1 is a block diagram of a typical dynamic voltage scaling circuit in accordance with the prior art.
Figure 2:
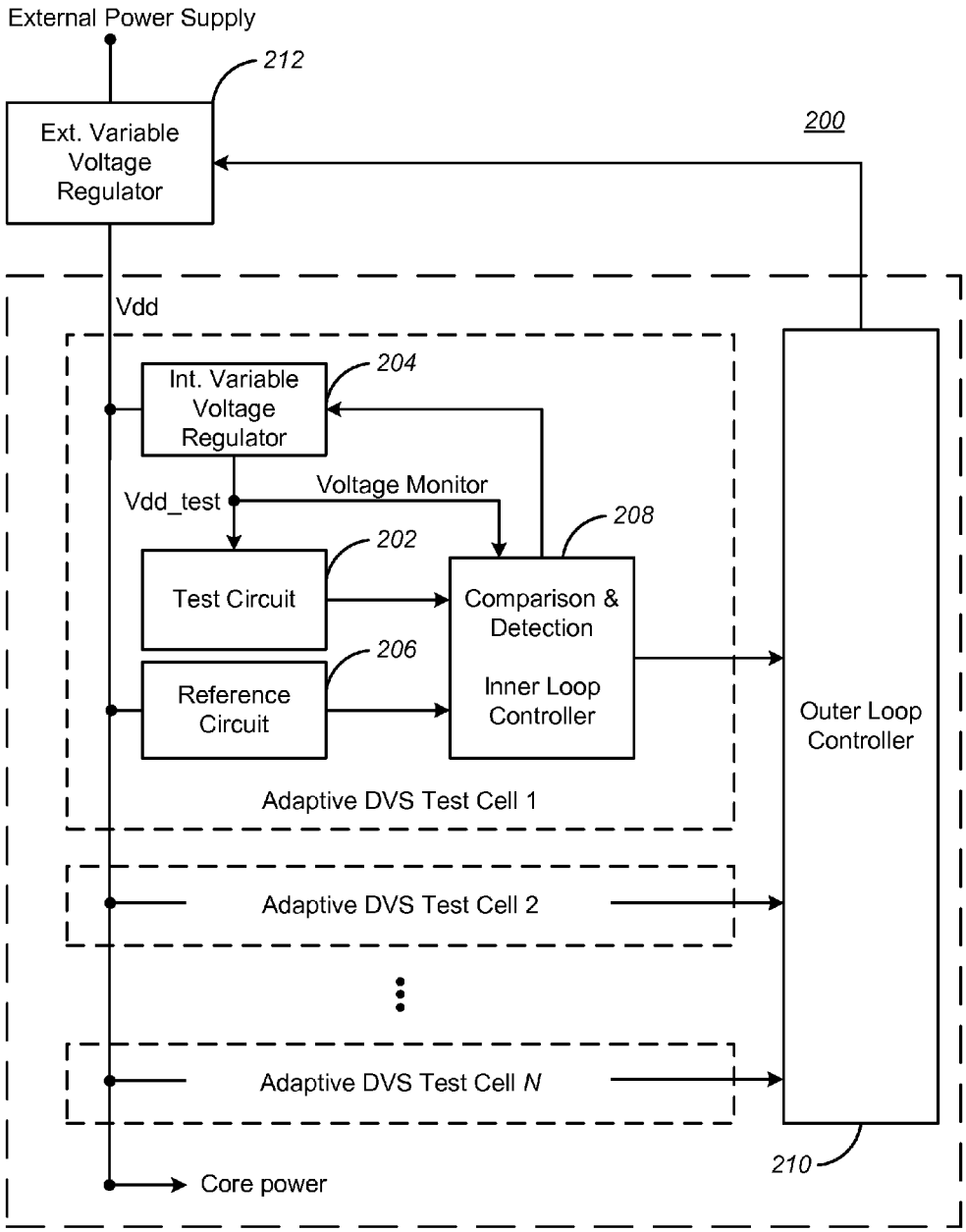
FIG. 2 is a block diagram of one embodiment of an adaptive dynamic voltage scaling circuit in accordance with the disclosed method and apparatus.

FIG. 2 is a block diagram of one embodiment of an adaptive dynamic voltage scaling (DVS) circuit 200 in accordance with the disclosed method and apparatus. The adaptive DVS circuit 200 includes a number of adaptive DVS test cells 1-N. Each adaptive DVS test cell includes a test circuit 202 which is designed to be process, temperature and voltage dependent so that critical timing (e.g., setup and hold times) can be tested and failure detected when the voltage applied to the test circuit 202 is too low. Examples of such circuits include ring oscillators, frequency dividers (for example divide-by-three or divide-by-five circuits), and comparators, but other circuits known in the art that exhibit comparable process and voltage dependencies may be used to facilitate detection of failures of most critical elements.

Each test circuit 202 should be based on the standard cells sizes used in the IC design (e.g., 7-track, 10-track, 12-track, 14-track, etc.). Each test circuit 202 also should be implemented using transistor types similar to the ones used on the IC in the region of the test circuit 202, such as ultra-high Vt (UHVT), high Vt (HVT), standard Vt (SVT), low Vt (LVT), and ultra-low Vt (ULVT) transistors. However, the test circuits 202 need not be identical in all test cells, so that different circuits may be used in different locations on a die and fabricated using different standard cell sizes and transistor types.

Each test circuit 202 is coupled to an internal variable voltage regulator 204, which may be, for example, a low-dropout (LDO) regulator. Each internal variable voltage regulator 204 is coupled to an external (to the adaptive DVS test cell circuitry; it may still be on the same die) variable voltage regulator 212, which is implemented in the illustrated embodiment as a switching DC/DC converter type regulator to achieve better efficiency, since it provides a relatively large amount of power, cumulatively, for the IC core (most of the power) as well as for the adaptive DVS test cells 1-N. The external variable voltage regulator 212 is the primary voltage source for either the entire IC die or for a substantial portion of the IC die in cases where the power requirements of the IC die requires additional external voltage regulators to power other parts of the die.

An LDO regulator is a DC linear voltage regulator which can operate with a very small input-output differential voltage and maintain a (substantially) constant output voltage with respect to a varying input voltage. Each internal variable voltage regulator 204 provides an output voltage Vdd_test from a voltage Vdd provided by the external variable voltage regulator 212.

Variable LDO regulators work well as internal variable voltage regulators 204 within the adaptive DVS circuit 200 because the current to each test circuit 202 is very small, so the LDO pass elements (e.g., pass transistors) can be small in size. This also means that the power loss in the LDO's is small, in most cases negligible and having no impact on the overall power consumption of the system. If more headroom (dropout) voltage is required for LDO operation, the LDO's may be powered from a different (higher) voltage that is typically available elsewhere in an IC design, such as a system-on-a-chip (SoC) IC design.

Each adaptive DVS test cell 1-N also includes a reference circuit 206 that is identical (or substantially similar) to the test circuit 202 within that test cell. Each reference circuit 206 is coupled to the output voltage Vdd of the external variable voltage regulator 212, and provides a "reference" or "template" for comparison against which the operation (and failure point) of an associated test circuit 202 is judged. The test circuit 202 and reference circuit 206 both may receive a signal from a source, such as a clock circuit or element (not shown in FIG. 2), if they need a timing or frequency source to perform the required function. For example, a common high speed clock may be applied to both circuits to perform frequency division.

In the preferred embodiment, the test circuit 202 and reference circuit 206 of each adaptive DVS test cell are physically placed at close proximity to each other on the die, thus minimizing spatial geometry/doping/temperature differences. Because the test circuit 202 and reference circuit 206 of each adaptive DVS test cell are essentially the same, and physically placed at close proximity to each other on the die, both should perform essentially identically at the same applied voltage (e.g., when Vdd_test is set initially approximately equal to Vdd).

It should be noted that Vdd and Vdd_test are two different voltage domains. It is well known in the art that coupling of circuits between different voltage domains may require level-shifters to ensure proper signal levels and drive conditions. For example, a common clock driver in the Vdd voltage domain driving a circuit in the Vdd_test domain may need a level shifter for proper operation. Similarly, the output of a test circuit 202 powered by Vdd_test may need a level shifter to drive the comparison and detection circuit 208. Whether a level shifter is needed or not may depend on the amount of voltage difference between the two domains. The smaller the voltage difference between the two voltage domains, the less likely that level shifters are needed. Accordingly, restricting the range of voltages for Vdd_test relative to Vdd to no more than what is needed to ensure that the cross-over point of the test circuit 202 is determined (i.e., a minimum sufficient range for the purpose of determining the operational cross-over point of the test circuit 202) may facilitate simpler coupling circuits between the two voltage domains.

The outputs of the test circuit 202 and the reference circuit 206 of each adaptive DVS test cell, along with the Vdd_test output of the associated internal variable voltage regulator 204, are coupled to a comparison and detection circuit 208. The outputs of the test circuit 202 and the reference circuit 206 may be, for example, voltage dependent frequencies or voltage levels. The comparison function of the comparison and detection circuit 208 may be implemented, as one example, as a differential (error) amplifier that outputs a signal that reflects any differences between the outputs of the test circuit 202 and the reference circuit 206. The detection function of the comparison and detection circuit 208 may be implemented as a voltage measurement of Vdd_test captured at the cross-over point (for example, as "Vxover") where the error amplifier indicates a difference between the outputs of the test circuit 202 and the reference circuit 206 (or, alternatively, where the error amplifier indicates equivalence between the outputs of the test circuit 202 and the reference circuit 206 if the incrementing approach described below is used). In another example, the comparison may be accomplished by a digital logic circuit, such as an XOR gate. Such XOR gate essentially conducts a bit-by-bit comparison, outputting a low output state (0) when the two compared signals are the same (indicating correct operation) and a high state (1) when the two signals are different. Averaging and other processing methods can be used if needed to smooth out the response and increase the reliability of cross-over detection as well as to reduce false cross-over detections. Such smoothing may be desirable to reduce voltage ripple and/or noise effects caused by toggling between fail and no-fail states in the vicinity of the cross-over point.

The comparison and detection circuit 208 may also include a simple sequencer that outputs a control voltage to the internal variable voltage regulator 204 that drives an associated adaptive DVS test cell, and causes the output Vdd_test of the internal variable voltage regulator 204 to decline from (approximately) Vdd to a lower voltage until the detection function of the comparison and detection circuit 208 indicates that the outputs of the test circuit 202 and the reference circuit 206 are no longer identical (a decrementing approach). Alternatively, the internal variable voltage regulator 204 can be operated with an initially low output value (e.g., 70% of Vdd) which is increased until the test circuit 202 changes from an incorrect, non-operational or failed state to a correct, operational state (an incrementing approach).

In some cases, it may be useful to use both an incrementing and decrementing approach. For example, in general, the direction of the Vdd_test voltage change (increasing or decreasing) when traversing the cross-over point should have little or no effect on the value of the cross-over point (i.e., there should be little or no hysteresis). However, if the circuits do exhibit hysteresis, then testing the cross-over points in both directions and using the larger value of the two may be used as the failure criteria. Furthermore, the speed or rate of change of the Vdd_test voltage should have little or no effect on the cross-over point value, as such speed is much slower (practically static) in comparison with the high speeds at which the test circuit 202 is tested. For example, the Vdd_test voltage may be changing on a scale of milliseconds or seconds, while the test circuit 202 may be tested at orders of magnitude faster, e.g., on a nanosecond scale.

More simply, in the decrementing approach, the comparison and detection circuit 208 behaves as an inner control loop that drives the Vdd_test output of an internal variable voltage regulator 204 (which only powers the test circuit 202 of a test cell) down from Vdd and monitors the operation of the test circuit 202 until a cross-over point is achieved, where the test circuit 202 fails to operate like an associated reference circuit 206 (which is always powered by Vdd). In the alternative incrementing approach, the inner control loop drives the Vdd_test output of the internal variable voltage regulator 204 up towards Vdd from a starting value (e.g., 70% of Vdd towards Vdd) below the operating voltage required by the test circuit 202, until a cross-over point is achieved where the test circuit 202 begins to operate like the reference circuit 206. In either case, when the cross-over point is detected, the voltage level of Vdd_test at that point (=Vxover) is measured or determined by the comparison and detection circuit 208. The comparison and detection circuit 208 may also include measurement of the Vdd voltage, or measurement of the difference between the Vdd and Vdd_test voltages. The Vdd value or the difference Vdd−Vdd_test value may be reported to an outer loop controller circuit 210.

Once a test circuit 202 cross-over point occurs in an adaptive DVS test cell, in the preferred embodiment a margin is added to Vxover and the output Vdd of the external variable voltage regulator 212 is adjusted so that Vdd=Vxover+margin. Such adjustment may be accomplished in known fashion by an outer loop controller 210 that controls the external variable voltage regulator 212 in response to the determination of Vxover by the comparison and detection circuit 208. The outer loop controller 210 may measure the Vdd voltage directly (not shown) in order to be able to adjust Vdd to Vxover+margin, or the controller 210 may rely on the reported Vdd value or the difference Vdd−Vdd_test obtained from the comparison and detection circuit 208.

In general, the margin added to the Vxover should be as small as possible, but sufficient to ensure reliable operation. The value of the margin may be fixed or may be programmable, optimized based on factors such as voltage ripple, voltage measurement or comparison accuracy, and other uncertainties in the system.

As an example, if Vdd is initially 1.1V, and Vxover is determined to be 0.80V, then the outer loop controller 210 may set the external variable voltage regulator 212 so that Vdd=0.83V, which provides a margin of 30 mV or approximately 4% above Vxover. The 30 mV margin should be sufficient to absorb a Vdd ripple of, for example, 20 mV (which may be a residual ripple of the external power supply source combined with the ripple caused by dynamic load changes on the Vdd line) and a voltage accuracy measurement/comparison of about 1%. The Vdd=0.83V operating voltage in this example is in contrast to the Vdd=0.9V voltage that would be imposed with typical prior art techniques.

For most IC designs, it is beneficial to have a plurality of adaptive DVS test cells 1-N distributed across an IC die such that the test circuits 202 and reference circuits 206 reflect the transistor speed variations that occur across the dimensions of the die due to process variations and characteristics of the die doping and geometry. When more than one adaptive DVS test cell is implemented in an IC design, the outer loop controller 210 may include the ability to determine the highest value of Vxover ("Vxover_max") determined by the different adaptive DVS test cells (i.e., the worst case instance) and set the external variable voltage regulator 212 such that Vdd=Vxover_max+margin.

In alternative embodiments, one or a small number of internal variable voltage regulators 204 may be time-shared (multiplexed) over the adaptive DVS test cells 1-N so that Vxover is determined for each test cell, but not necessarily concurrently. Similarly, one or a small number of comparison and detection circuits 208 may be time-shared (multiplexed) over the adaptive DVS test cells 1-N so that Vxover is determined for each test cell, but again not necessarily concurrently. Thus, while FIG. 2 shows that each adaptive DVS test cell 1-N includes a dedicated internal variable voltage regulator 204 and comparison and detection circuit 208, these later circuits may instead be simply connectable to adaptive DVS test cells each comprising at least one test circuit 202 and at least on reference circuit 206.

In yet another embodiment, each adaptive DVS test cell may have several test circuits 202 associated with a single reference circuit 206, or several reference circuits 206 associated with a single test circuit 202. Such configurations may be useful, for example, to obtain an average of Vxover values for each test cell, or a maximum Vxover value for each test cell. Further, the addition of a margin value to a measured or determined Vxover value may be performed in the outer loop controller 210 rather than by each comparison and detection circuit 208.

In the prior art, the voltage to a test circuit in an IC design is adjusted to make the test circuit operate at a pre-determined selected (target) frequency, as described in the background above. However, the voltage set by this process, referenced to a selected frequency, is not necessarily the lowest voltage at which the IC design as a whole could operate. In reality, many individual ICs could operate at voltages below the selected limit (and thus dissipate less power), but because of worst case units resulting from process variations, the entire population of IC dies must be subjected to this limit in order to secure sufficient margin with the prior art method. Accordingly, power is wasted, producing excess heat and reducing battery life for battery powered systems such as cell phones.

In contrast, an advantage of the disclosed method and apparatus in comparison with the prior art is that the disclosed method and apparatus allows each IC die to be non-intrusively tested while in actual operation to determine the actual minimum voltage at which the circuitry on that die will operate (and below which the circuitry fails), and then adds some margin to that measured minimum voltage level to ensure proper operation. Further, the disclosed method and apparatus allows the measurement of minimum operational voltage to be made on a real-time basis, thus allowing periodic adjustment of the applied voltage to track and meet current conditions (e.g., environmental conditions such as temperature, and aging effects on an IC die).

By measuring the actual minimum voltage at which the circuitry on an IC die will operate, the adaptive DVS approach of the disclosed method and apparatus in general can lower the applied voltage to that instance of the IC design below the level that would be set by the frequency-based testing of the prior art DVS approach, thereby achieving power savings in comparison to the prior art. Furthermore, a designer can design a more efficient circuit, for example by using SVT devices instead of ULVT devices, resulting in smaller die size and lower leakage power, because the designer can count on the adaptive DVS system to ensure enough voltage for proper circuit operation under actual operating conditions. This provides an additional degree of freedom in the array of design trade-offs during the IC design phase.

The disclosed method and apparatus also encompasses several methods of using adaptive dynamic voltage scaling for IC designs that compensate for some of the effects of PVT dependent characteristics on the fabrication of advanced IC's but allow lower margins and provide small die size, high die yields, and lower power usage in comparison to the prior art. In one embodiment, the method includes:

providing a test circuit powered by an associated variable voltage source, where the associated variable voltage source is powered by a primary variable voltage source;

providing a reference circuit essentially identical to and in proximity to an associated test circuit and powered by the primary variable voltage source;

comparing the functionality of the test circuit against the functionality of the associated reference circuit over a range of voltage values from the associated variable voltage source until a cross-over voltage value is determined at which the test circuit reaches a cross-over point; and adjusting the voltage of the primary variable voltage source to be marginally greater than the cross-over voltage value.

A number of embodiments of the disclosed method and apparatus have been described. It is to be understood that various modifications may be made without departing from the spirit and scope of the invention. In particular, the invention encompasses numerous other embodiments of the disclosed method and apparatus having equivalent structure and/or function. For example, some of the steps described above may be order independent, and thus can be performed in an order different from that described. Accordingly, it is to be understood that the foregoing description is intended to illustrate and not to limit the scope of the invention, which is defined by the claims presented, and the equivalents thereof.

What is claimed is:

1. An adaptive dynamic voltage scaling circuit, including:

(a) a primary variable voltage source for providing an initial circuit voltage;

(b) at least one variable voltage source powered by the primary variable voltage source;

(c) at least one test cell including:

(1) at least one test circuit powered by an associated one of the variable voltage sources; and (2) at least one reference circuit, each essentially identical to and in proximity to at least one associated test circuit in the same test cell and powered by the primary variable voltage source;

(d) a comparison and detection circuit coupled to at least one variable voltage source and at least one test cell, for comparing the functionality of the at least one test circuit within a coupled test cell against the functionality of the at least one associated reference circuit within such coupled test cell over a range of voltage values from the variable voltage source associated with such test cell until a cross-over voltage value is determined at which the at least one test circuit reaches a cross-over point of functionality; and (e) a controller circuit coupled to the comparison and detection circuit for adjusting the voltage of the primary variable voltage source to be marginally greater than the cross-over voltage value.

2. The adaptive dynamic voltage scaling circuit of claim 1, wherein each variable voltage source includes a low-dropout voltage regulator.

3. The adaptive dynamic voltage scaling circuit of claim 1, wherein the comparison and detection circuit includes sequencing circuitry for controlling the voltage output of at least one coupled variable voltage source.

4. The adaptive dynamic voltage scaling circuit of claim 1, wherein adjusting the voltage of the primary variable voltage is performed on a real-time basis.

5. An adaptive dynamic voltage scaling circuit, including:

(a) primary voltage means for providing an initial circuit voltage;

(b) variable voltage means, powered by the primary voltage means, for providing at least one variable voltage;

(c) at least one test cell including (1) at least one test circuit powered by the variable voltage means and (2) at least one reference circuit, each essentially identical to and in proximity to at least one associated test circuit in the same test cell and powered by the primary voltage means;

(d) comparison and detection means coupled to the variable voltage means and at least one test cell, for comparing the functionality of the at least one test circuit within a coupled test cell against the functionality of the at least one associated reference circuit within such coupled test cell over a range of voltage values from the variable voltage means until a cross-over voltage value is determined at which the at least one test circuit reaches a cross-over point of functionality; and (e) controller means coupled to the comparison and detection means for adjusting the voltage of the primary variable voltage means to be marginally greater than the cross-over voltage value.

6. The adaptive dynamic voltage scaling circuit of claim 5, wherein the variable voltage means includes a low-dropout voltage regulator.

7. The adaptive dynamic voltage scaling circuit of claim 5, wherein the comparison and detection means includes means for controlling the voltage output of the variable voltage means.

8. The adaptive dynamic voltage scaling circuit of claim 5, wherein adjusting the voltage of the primary variable voltage is means performed on a real-time basis.

9. A method for adaptive dynamic voltage scaling on an integrated circuit die, including:

(a) providing a test circuit powered by an associated variable voltage source, where the associated variable voltage source is powered by a primary variable voltage source;

(b) providing a reference circuit essentially identical to and in proximity to an associated test circuit and powered by the primary variable voltage source;

(c) comparing the functionality of the test circuit against the functionality of the associated reference circuit over a range of voltage values from the associated variable voltage source until a cross-over voltage value is determined at which the test circuit reaches a cross-over point; and (d) adjusting the voltage of the primary variable voltage source to be marginally greater than the cross-over voltage value.

10. The method of claim 9, wherein each variable voltage source includes a low-dropout voltage regulator.

11. The method of claim 9, wherein comparing the functionality of the test circuit against the functionality of the associated reference includes varying the voltage output of at least one coupled variable voltage source.

12. The method of claim 9, wherein adjusting the voltage of the primary variable voltage is performed on a real-time basis.

* * * * *